US010914547B2

(12) United States Patent
Liu

(10) Patent No.: US 10,914,547 B2
(45) Date of Patent: Feb. 9, 2021

(54) BOLT RECIPROCATION STRUCTURE OF TOY GUN

(71) Applicant: ACTION-ARMY COMPANY, New Taipei (TW)

(72) Inventor: Yung-Nung Liu, New Taipei (TW)

(73) Assignee: ACTION-ARMY COMPANY, New Taipei (TW)

( * ) Notice: Subject to any disclaimer, the term of this patent is extended or adjusted under 35 U.S.C. 154(b) by 0 days.

(21) Appl. No.: 16/459,570

(22) Filed: Jul. 1, 2019

(65) Prior Publication Data

US 2021/0003365 A1 Jan. 7, 2021

(51) Int. Cl.
*F41B 11/89* (2013.01)
*F41B 11/642* (2013.01)
*F41B 11/62* (2013.01)

(52) U.S. Cl.
CPC ..... *F41B 11/89* (2013.01); *F41B 11/642* (2013.01); *F41B 11/62* (2013.01)

(58) Field of Classification Search
CPC ..... F41B 11/62; F41B 11/64; F41B 11/642; F41B 11/643; F41B 11/68; F41B 11/73; F41B 11/89; F41B 11/72–723
USPC ..... 124/66
See application file for complete search history.

(56) References Cited

U.S. PATENT DOCUMENTS

2004/0089280 A1* 5/2004 Kunimoto ..... F41B 11/723 124/76
2017/0153081 A1* 6/2017 Hu ..... F41B 11/642

* cited by examiner

*Primary Examiner* — Stephen Johnson
*Assistant Examiner* — Benjamin S Gomberg
(74) *Attorney, Agent, or Firm* — Leong C. Lei

(57) ABSTRACT

A structure includes a bolt body combined in a toy gun, a bullet feeding element, a high pressure air opening, an air outlet opening, an air valve assembly, a piston element, a recoil bar at one side of the bolt body, a first elastic element fit over the recoil bar, a bolt sleeve defined at one side of the bolt body and movably fit over the recoil bar, and an abutting section. When the high pressure air is input through the high pressure air opening, the air valve assembly may change a flowing direction thereof and drive the abutting section to move so as to control rearward movement of the piston element, the bolt body, and the bullet feeding element. A first elastic element that is operable to move the bolt body forward is disposed on the recoil bar outside the bolt body.

7 Claims, 12 Drawing Sheets

BOLT RECIPROCATION STRUCTURE OF TOY GUN

TECHNICAL FIELD OF THE INVENTION

The present invention provides a bolt reciprocation structure of a toy gun that includes a recoil bar and a recoil spring (a first elastic element) that are disposed outside a bolt body so as to simplify structure and spatial arrangement of an interior of the bolt body.

DESCRIPTION OF THE PRIOR ART

To increase interesting of use, a known toy gun is provided with functions that imitate a real gun and may also involve a bullet forwarding structure of which the design is aimed to simplification and operation reliability, in order to provide a user with the best entertainment of shooting operation.

However, the known bullet forwarding device suffers complication of structure and excessively enlarge the size of a toy gun that involves such a bullet forwarding device, making it adverse for hand holding and operating by a user. Further, such a known bullet forwarding device is formed by connecting multiple linking bars and this often leads to instability of operation. Further, for operation safety and easiness of design, most of the linking bars are arranged inside the toy gun. Particularly, a recoil bar and a recoil spring arranged thereon for driving reciprocation of a bolt are arranged inside the bolt, and this complicates the inside structure and is vulnerable to damage and hard to maintain and repair.

SUMMARY OF THE INVENTION

The primary objective of the present invention is to arrange a recoil bar outside a bolt body and to achieve a reciprocal movement of the bolt body by using the bolt sleeve compressing a first elastic element provided on the recoil bar in combination with a pushing force provided by high pressure air, so as to simplify the structure and spatial arrangement of the interior of the bolt body and thus reducing the chance of malfunctioning and also reducing the difficulty of maintenance and repairing.

The present invention provides a bolt reciprocation structure, which generally comprises: a bolt body combined inside a toy gun and reciprocally movable at one side of a barrel of the toy gun. A bullet feeding element is movably arranged between the bolt body and the barrel. A high pressure air opening is defined in one side of the bullet feeding element for input and output of high pressure air through the bullet feeding element. An air outlet opening is formed in a front end of the bullet feeding element. An air valve assembly is arranged on the bullet feeding element for changing a flowing direction of the high pressure air by blocking the air outlet opening. A piston element is defined inside the bolt body to drive the bolt body to move when the high pressure air is input. The toy gun is provided thereon with a recoil bar located at one side of the bolt body. The recoil bar is fit with a first elastic element. At least one bolt sleeve is defined at one side of the bolt body and movably fit to the recoil bar for mutual pushing with the first elastic element. At least one abutting section is defined on the bolt sleeve to drive the bullet feeding element to move rearward when the bolt body is rearward moved.

When a user combines the present invention with a toy gun, before each time of firing, high pressure air moves, through the high pressure air opening, into the toy gun to flow in a direction toward the air outlet opening. At the moment, due to a negative pressure effect, the air valve assembly moves in a direction toward the flowing direction of air so as to block the air outlet opening, making the air or gas push the piston element and drive the bolt body to move rearward. Upon rearward movement of the bolt body, the bolt sleeve compresses the first elastic element on the recoil bar to store spring force and the abutting section abuts the bullet feeding element after the bolt sleeve has moved a predetermined distance, so as to cause the bullet feeding element to also move rearward. At this moment, a BB bullet may avoid the bullet feeding element and enters one side of the barrel, and the high pressure air opening is caused to interrupt a communication passage with the high pressure air. Then, the spring force of the first elastic element pushes the bolt sleeve to drive the bullet feeding element to forward the BB bullet into the bullet chamber to be ready for trigger pulling by a user. As such, by arranging the recoil bar that conducts a reciprocal movement on the bolt body and the first elastic element outside the bolt body, the existing functions of the bolt body can be preserved while the structure and spatial arrangement of the interior of the bolt body can be simplified to reduce the chance of malfunctioning and difficulty of maintenance and repairing.

DETAILED DESCRIPTION OF THE PREFERRED EMBODIMENT

Figure 1:
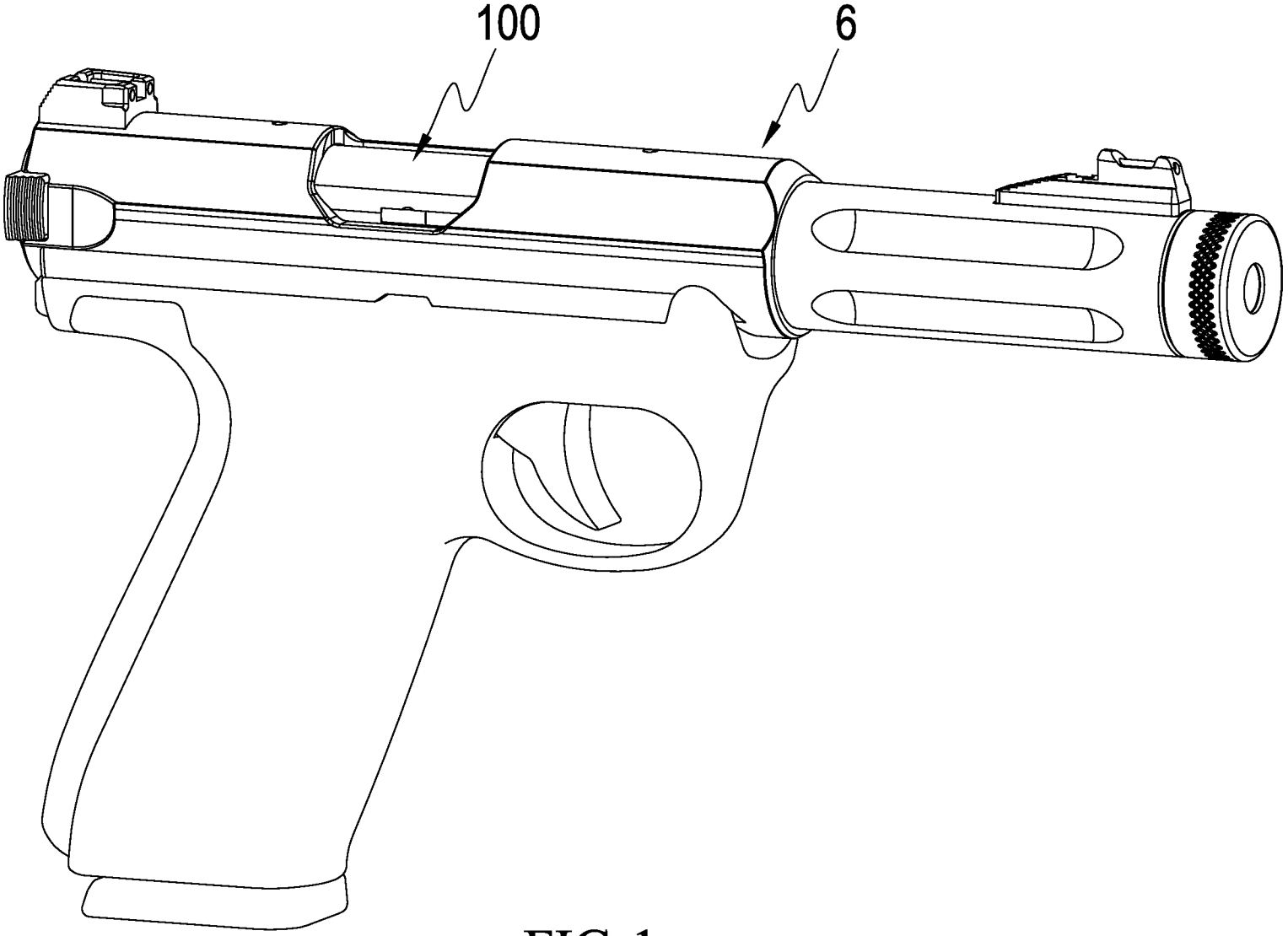
FIG. 1 is a perspective view showing the present invention combined with a toy gun.
Figure 2:
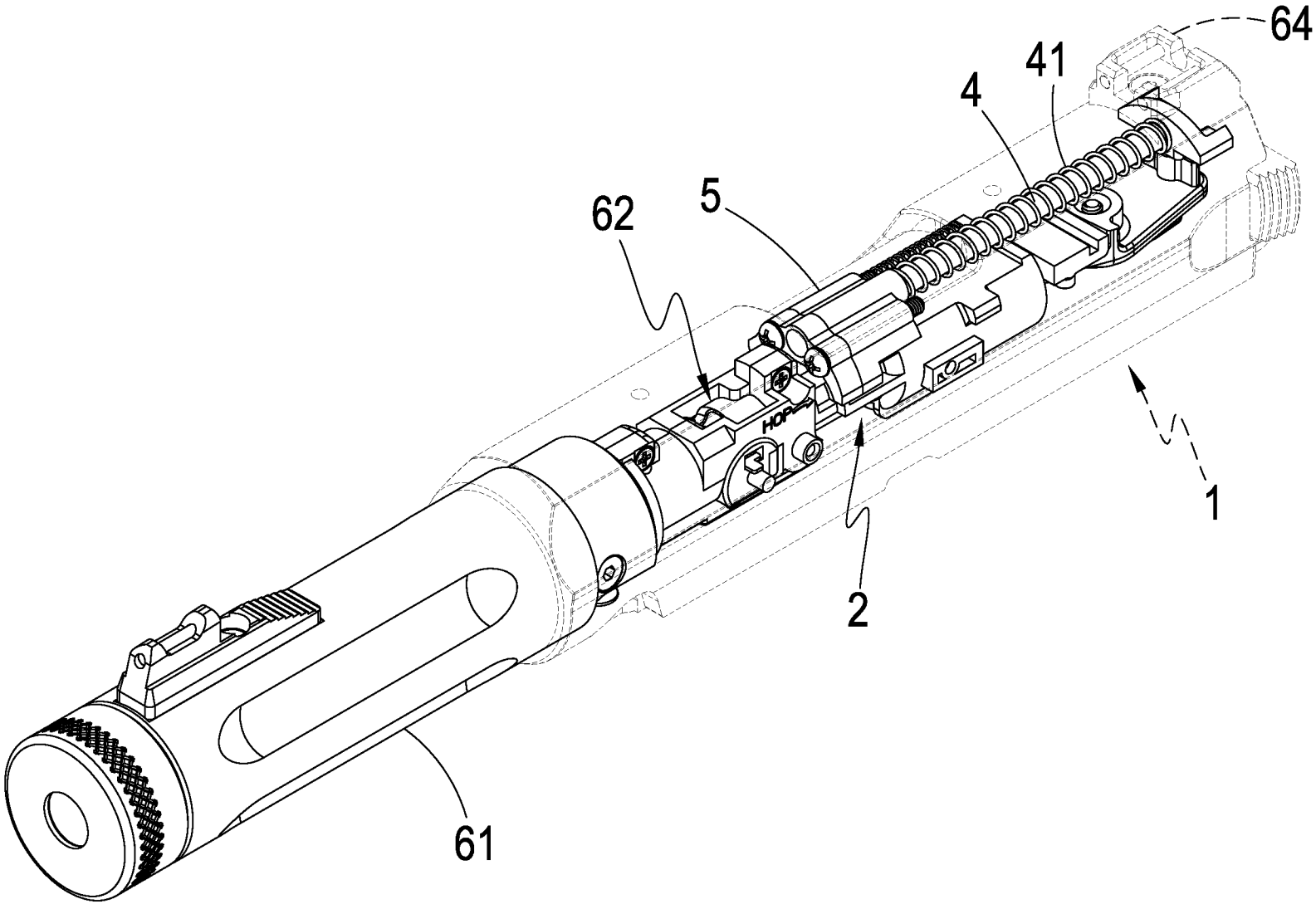
FIG. 2 is a perspective view, partly seeing through, of the present invention.

As shown in FIGS. 1-4, a bolt reciprocation structure 100 of the present invention generally comprises:

a bolt body 1, which is combined in an interior of a toy gun 6 and is reciprocally movable at one side of a barrel 61 of the toy gun 6, the toy gun 6 comprising a bullet chamber 62 defined at a rear end of the barrel 61 and located at one side of a bullet feeding element 2 that will be described hereinafter and a bullet passage 63 formed at one side of the bullet chamber 62;

a bullet feeding element 2, which is movably disposed between the bolt body 1 and the barrel 61, the bullet feeding element 2 comprising at least one drive end 21, one side of the bolt body 1 comprising at least one drive channel 11 for receiving and moving forward the drive end 21;

a high pressure air opening 22, which is defined at one side of the bullet feeding element 2 to allow for input and output of high pressure air into and out of the bullet feeding element 2;

an air outlet opening 23, which is defined in a front end of the bullet feeding element 2;

an air valve assembly 3, which is arranged on the bullet feeding element 2 to change a flow direction of the high pressure air by blocking the air outlet opening 23, the air valve assembly 3 comprising an air valve spring 31 arranged in an interior of the bullet feeding element 2, a movable member 32 arranged at one side of the air valve spring 31, an airtight sealing section 33 formed at one side of the movable member 32 that is distant from the air valve spring 31, and at least one vent hole section 34 formed in the movable member 32 for communication between the high pressure air opening 22 and the air outlet opening 23;

a position limiting section 24, which is defined in the interior of the bullet feeding element 2 for abutting and positioning the airtight sealing section 33;

a piston element 12, which is defined in the bolt body 1 for driving the bolt body 1 upon input of the high pressure air;

a recoil bar 4, which is arranged on the toy gun 6 and is located at one side of the bolt body 1;

a first elastic element 41, which is fit over the recoil bar 4;

at least one bolt sleeve 5, which is defined at one side of the bolt body 1 and is movably fit in the recoil bar 4 for mutually pushing the first elastic element 41;

at least one abutting section 51, which is defined in the bolt sleeve 5 to drive the bullet feeding element 2 upon rearward movement of the bolt body 1; and the toy gun 6 being further provided with a rear stop block 64 for fixing the recoil bar 4 and a front stop block 65 located at one side of the bolt sleeve 5 for limiting a spring-back movement of the bolt sleeve 5, the bolt sleeve 5 comprising a second elastic element 52 located at one side of the first elastic element 41 for forward pushing the bullet feeding element 2.

As shown in FIG. 1-12, although the structural features of the present invention involve arrangement of the recoil bar 4 and the first elastic element 41 on the outside of the bolt body 1, for the outside appearance of the toy gun 6, this does not make the recoil bar 4 and the first elastic element 41 exposed to the outside so that the existing structural features of a toy gun 6 are still preserved in respect of operation and outside appearance.

Figure 5:
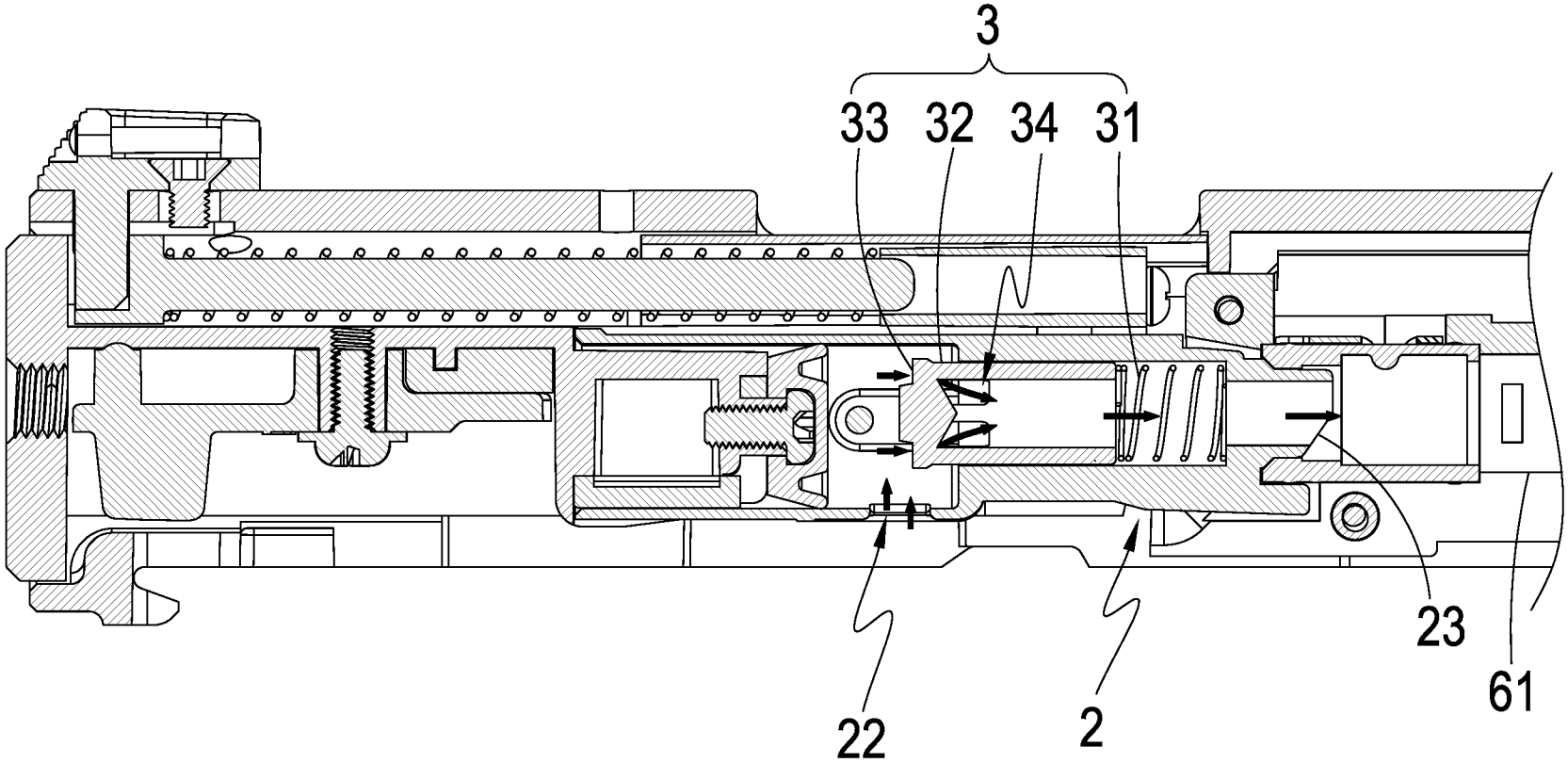
FIG. 5 is a schematic view illustrating an operation of an air valve assembly of the present invention.

In an actual operation, after each firing, the high pressure air opening 22 that is connected to a high pressure gas canister conducts in high pressure air and at this moment, the air outlet opening 23 at the front end of the bullet feeding element 2 is not shielded by a BB bullet and is thus still in communication with the barrel 61, so that the high pressure air follows the vent hole section 34 of the air valve assembly 3 to enter and moves in a direction toward the barrel 61. Through the fast movement of the high pressure air, a negative pressure effect is generated, making the high pressure air inside the bullet feeding element 2 to push the airtight sealing section 33 and thus driving the movable member 32 to move forward (namely in a direction toward a muzzle) and causing compression of the air valve spring 31 to store a spring force therein, thereby causing the airtight sealing section 33 to block a communication passage between the high pressure air opening 22 and the air outlet opening 23 (as shown in FIG. 5).

Figure 6:
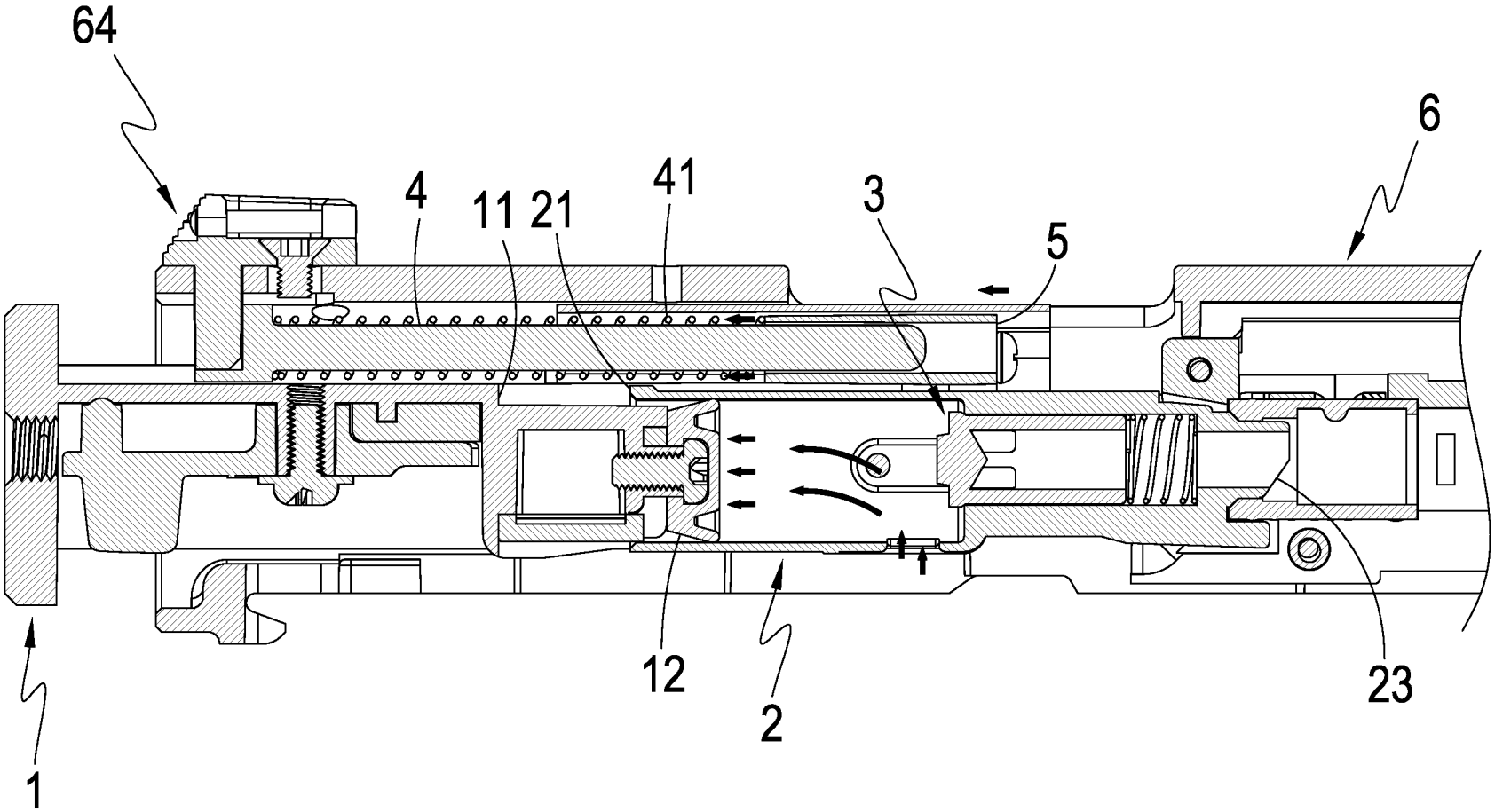
FIG. 6 is a schematic view showing an operation of a piston element of the present invention.

After the air valve assembly 3 blocks the air outlet opening 23, since the high pressure air is still continuously flowing into the bullet feeding element 2, the high pressure air is forced to flow toward the piston element 12 so that the high pressure air may also drive the piston element 12 and the bolt body 1 to move rearward, wherein since the bullet feeding element 2 is only inserted into the drive channel 11 of the bolt body 1 with the drive end 21 thereof, rearward movement of the bolt body 1 does not cause the bullet feeding element 2 to move rearward. At this moment, the bolt sleeve 5 that is defined at one side of the bolt body 1, due to being fit to the recoil bar 4 on the bolt body 1, causes compression of the first elastic element 41 at the same time when the bolt body 1 moves rearward (as shown in FIG. 6). In the instant embodiment, the recoil bar 4 is held in position by the rear stop block 64 disposed on the toy gun 6 in order to maintain the bolt sleeve 5 and the recoil bar 4 in a parallel condition and to ensure smooth movement thereof. However, the rear stop block 64 is just an example of this invention, and is not intended to limit the way that the recoil bar 4 is fixed or held in position.

Figure 7:
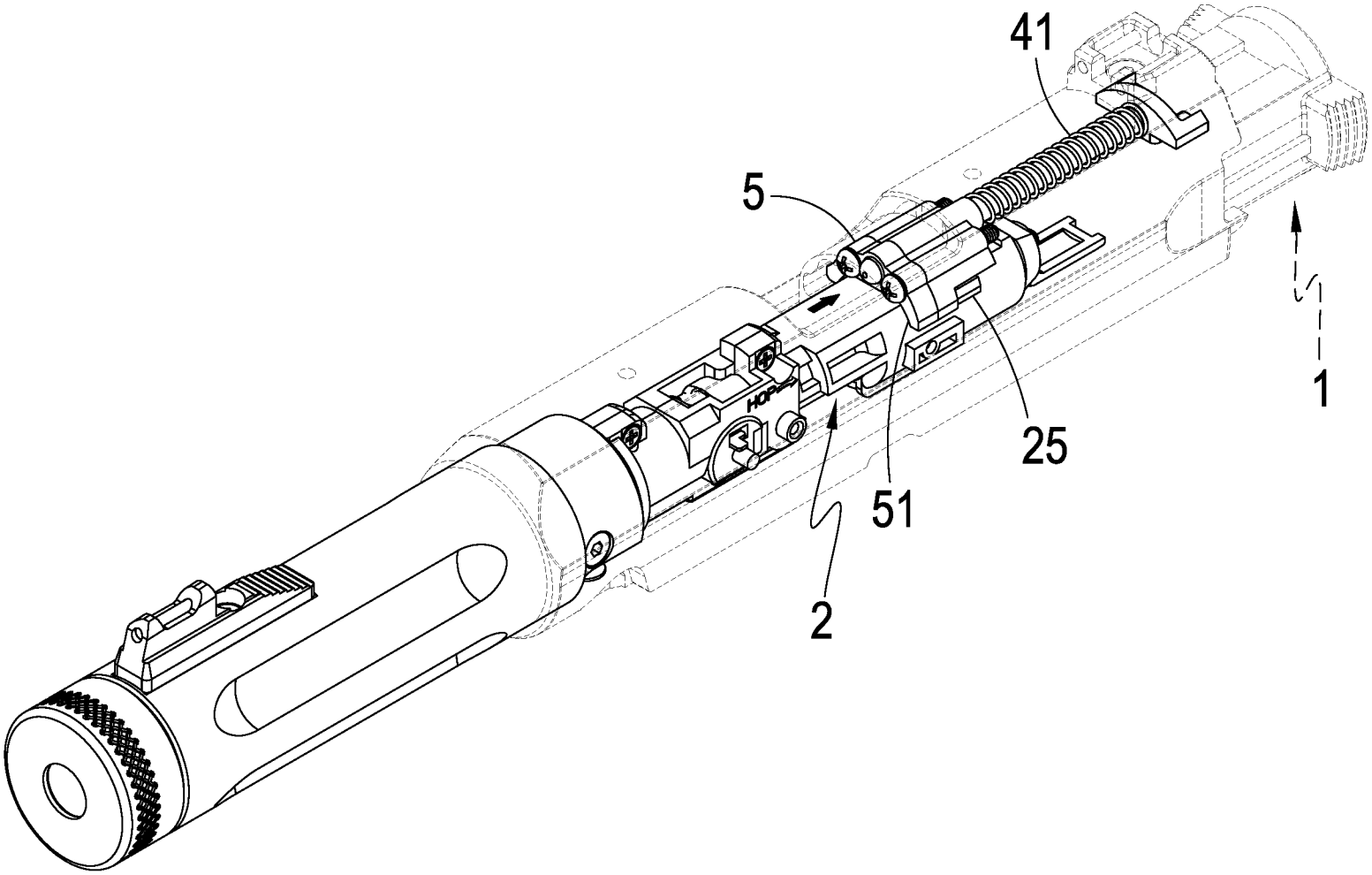
FIG. 7 is a first schematic view showing an operation of a bullet feeding element of the present invention.

During the course that the piston element 12, the bolt body 1, and the bolt sleeve 5 are continuously moving rearward, in addition to continuously compressing the first elastic element 41, when the bolt sleeve 5 rearward moves by a predetermined distance, the abutting section 51 is brought into abutting contact with the bullet feeding element 2 (wherein, in the instant embodiment, the bullet feeding element 2 is further provided with an abutting block 25 in operative collaboration with the abutting section 51; however, the way that the abutting section 51 drives the bullet feeding element 2 to move is not limited thereto), so that the bullet feeding element 2 and the bolt sleeve 5 move rearward synchronously (as shown in FIG. 7).

Figure 8:
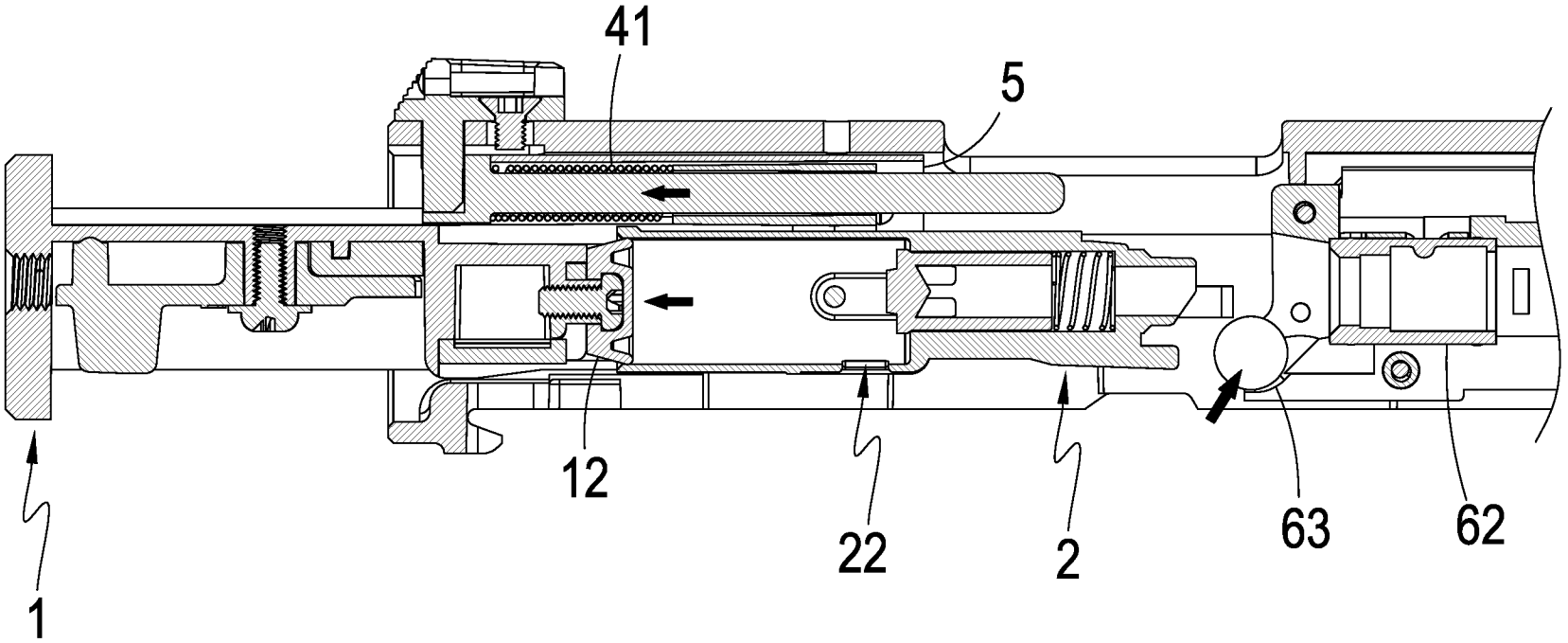
FIG. 8 is a second schematic view showing the operation of the bullet feeding element of the present invention.

When the bullet feeding element 2 moves rearward, a space is formed in the bullet passage 63 for input of a BB bullet, so that a BB bullet may be moved to the position where the bullet feeding element 2 is originally located and temporarily stay at one side of the bullet chamber 62. During the course that the piston element 12, the bolt body 1, the bolt sleeve 5, and the bullet feeding element 2 are continuously moving rearward, although connection between the high pressure air opening 22 and the high pressure gas canister may be interrupted by the rearward movement of the bullet feeding element 2, inertia still keeps the bolt body 1 continuously moving rearward until the inertial force gets less than the spring force of the first elastic element 41 (as shown in FIG. 8).

Figure 9:
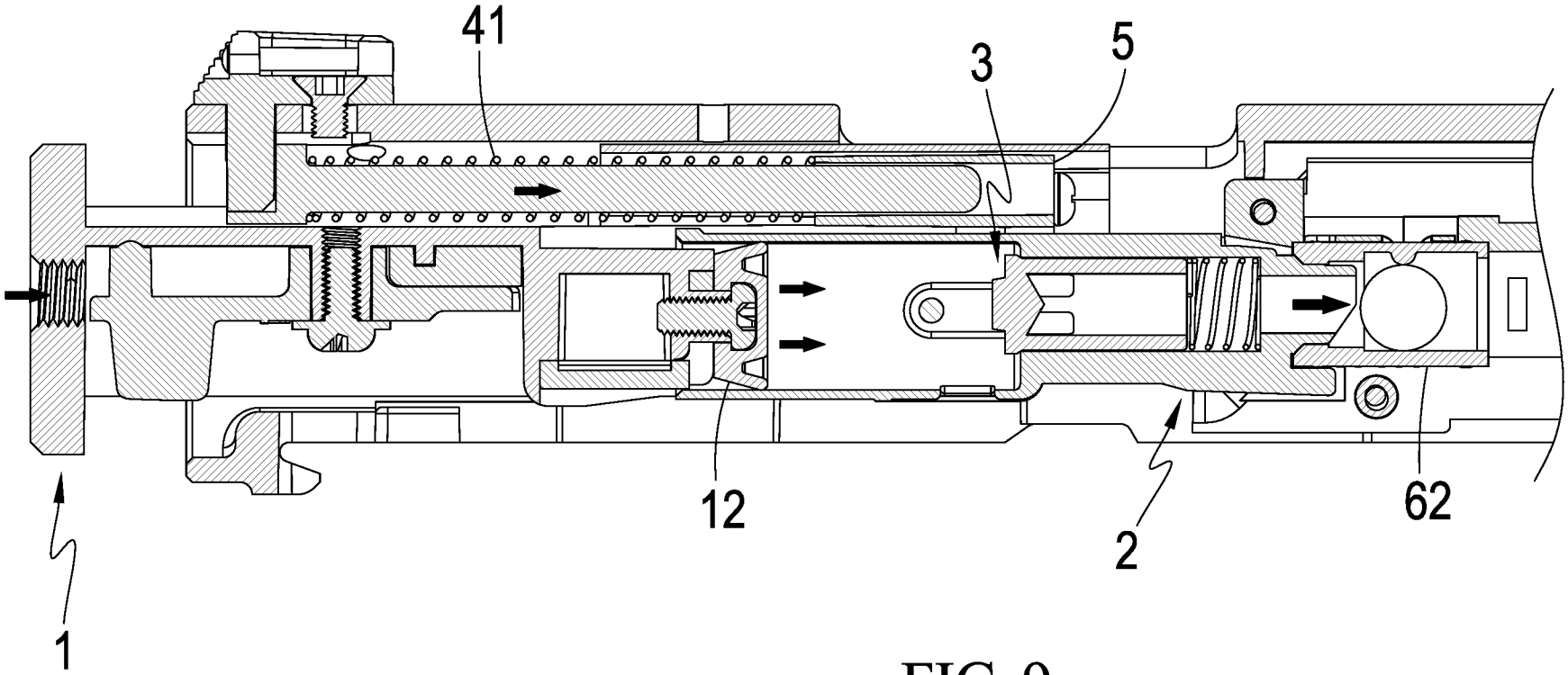
FIG. 9 is a schematic view showing an operation of a bolt body of the present invention.

Afterwards, the spring force that the first elastic element 41 pushes the bolt sleeve 5 drives the bolt body 1 and the piston element 12 to move forward, and at this moment, due to the space between the air valve assembly 3 and the piston element 12 being filled up with the high pressure air, the fore that moves the piston element 12 forward is insufficient to compress the space, so that the operation of compressing the high pressure air would cause an effect of driving the bullet feeding element 2 to move forward. As such, the front end of the bullet feeding element 2 would push the BB bullet, so as to drive the BB bullet into the bullet chamber 62 (as shown in FIG. 9).

Figure 10:
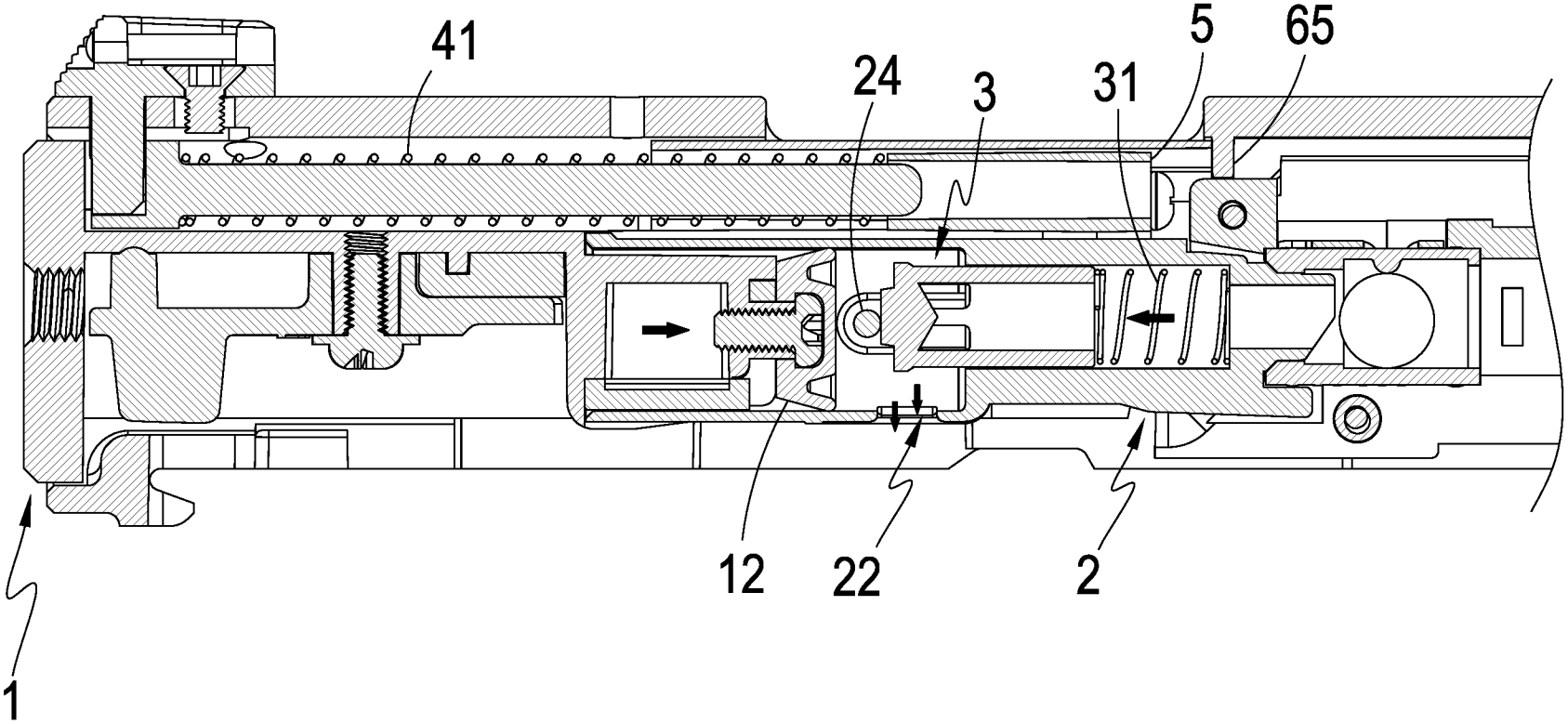
FIG. 10 is a schematic view illustrating pressure releasing according to the present invention.

Due to the forward movement of the bullet feeding element 2, the high pressure air opening 22 is allowed to restore connection with the high pressure gas canister. At this moment, the pressure inside the bullet feeding element 2 is greater than that of the outside, so that the high pressure air inside the bullet feeding element 2 would be released through the high pressure air opening 22. Due to such a pressure releasing operation, the air pressure inside the bullet feeding element 2 is made less than the spring force stored in the air valve spring 31 and the spring force of the first elastic element 41, so that the air valve assembly 3, the bolt body 1, and the piston element 12 are caused to return to the original position to complete an automatic returning operation (as shown in FIG. 10). Further, in the instant embodiment, at one side of the bolt sleeve 5, a front stop block 65 is provided for limiting the spring-back returning of the bolt sleeve 5, and also providing a cushioning effect for the spring-back returning of the bolt sleeve 5. However, the front stop block 65 is provided as an example for the instant embodiment and is not intended to limit the way that position limiting may be achieved for the bolt sleeve 5. The spring-back returning of the air valve assembly 3 makes use of the position limiting section 24 in the bullet feeding element 2 to prevent excessive spring-back returning of the air valve assembly 3. In the instant embodiment, the position limiting section 24 is made in the form of a pin having two ends respectively inserted into walls of the bullet feeding element 2. However, this is just an example of the position limiting section 24 for the instant embodiment and is not intended to limit the way of limiting the air valve assembly 3.

Figure 3:
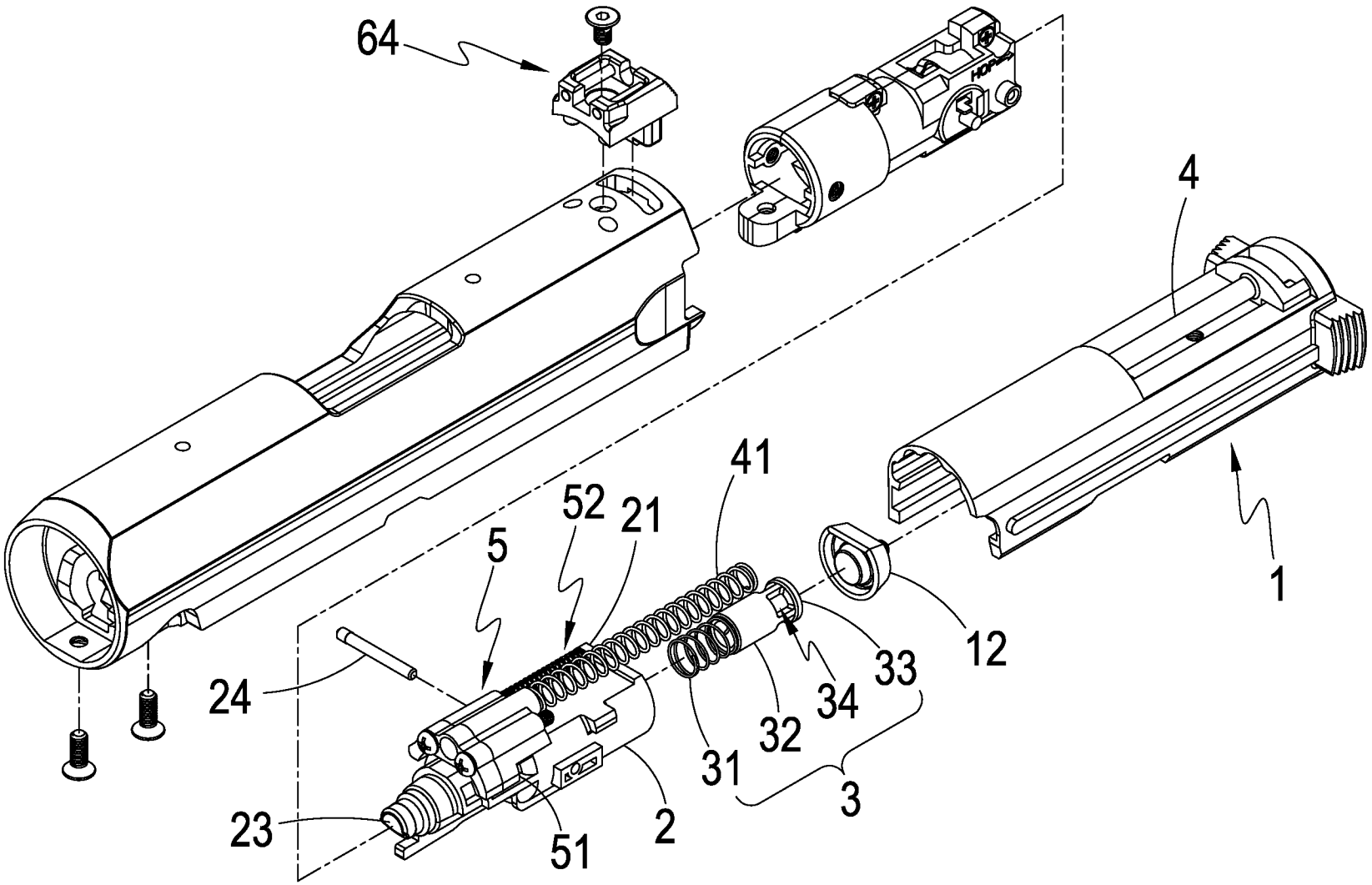
FIG. 3 is an exploded view of the present invention.
Figure 4:
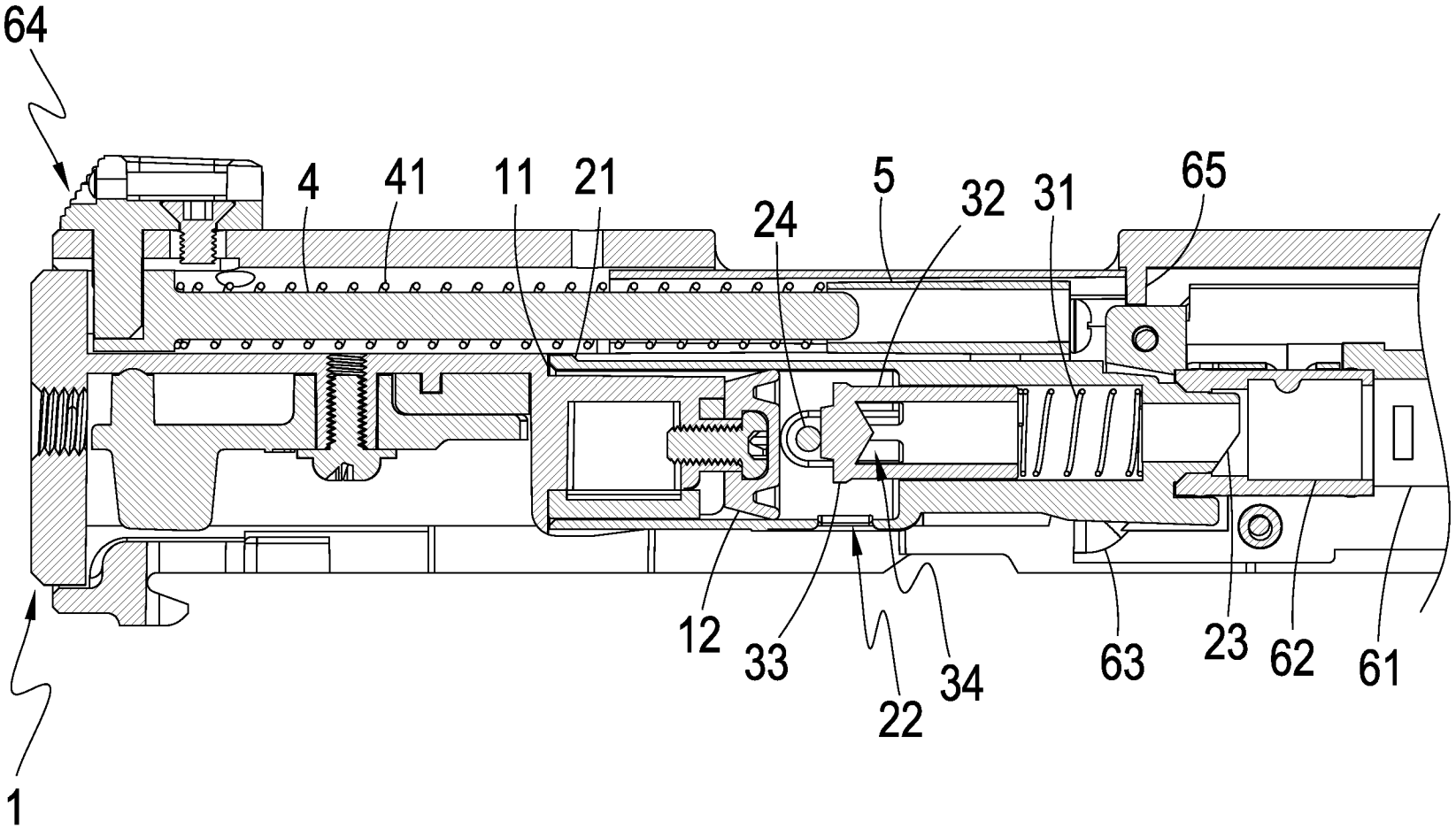
FIG. 4 is a cross-sectional view of a portion of FIG. 2 of the present invention.
Figure 11:
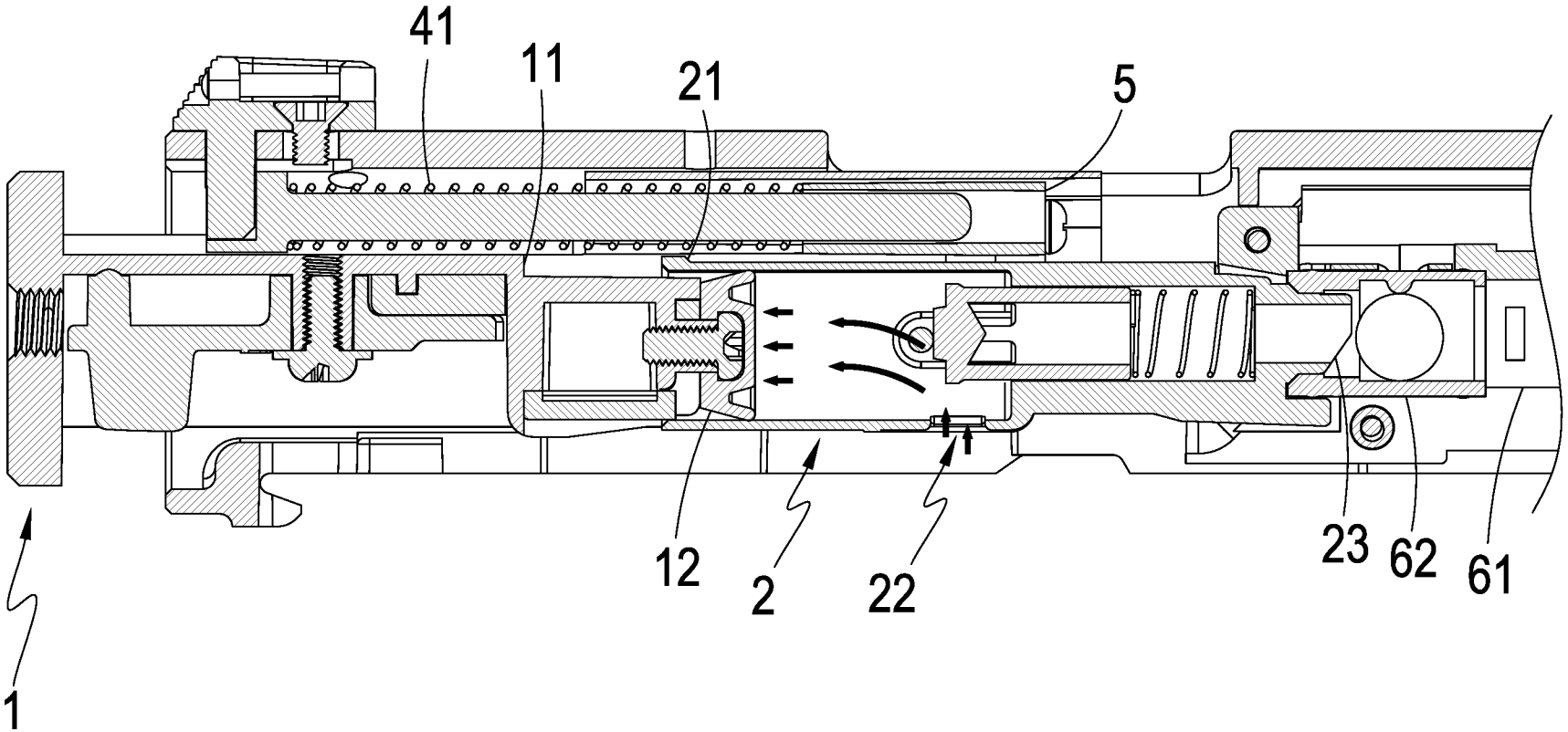
FIG. 11 is a first schematic view illustrating firing according to the present invention.
Figure 12:
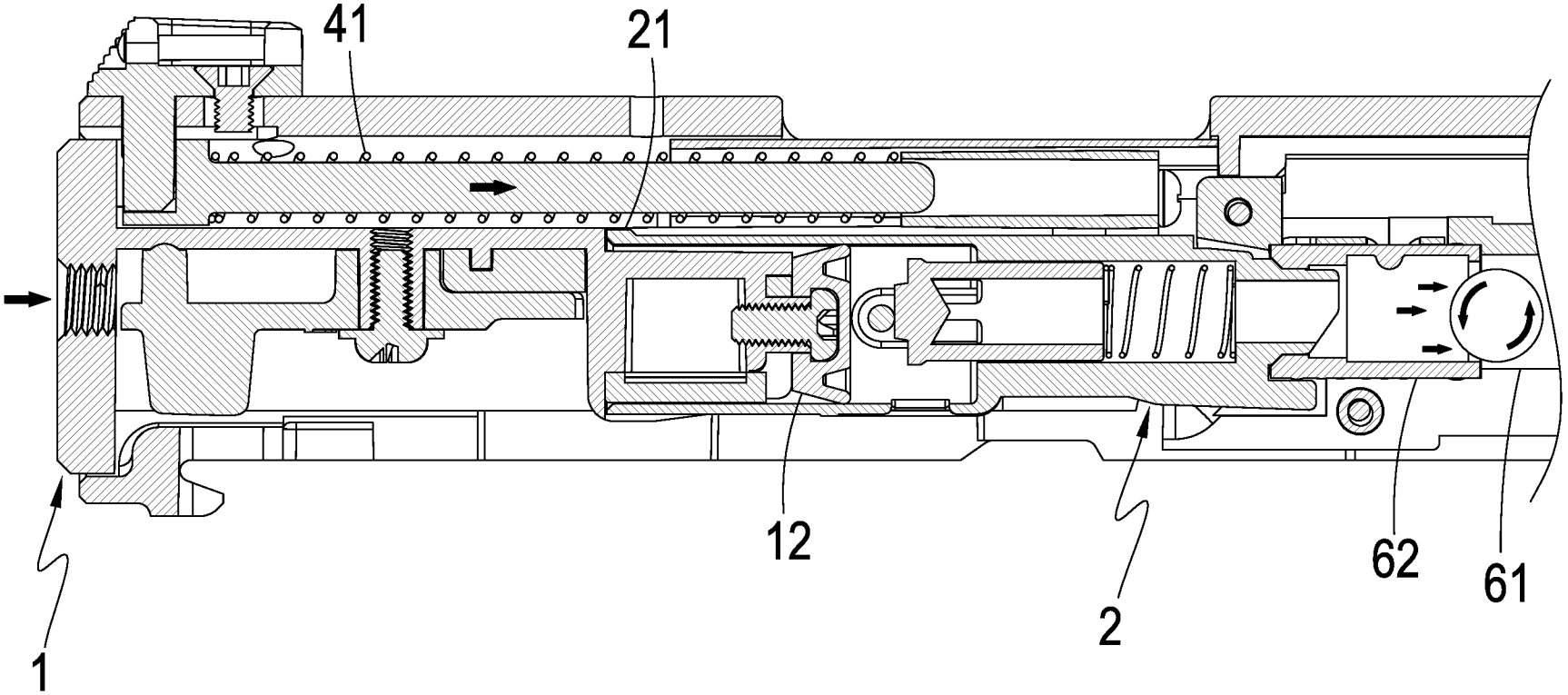
FIG. 12 is a second schematic view illustrating firing according to the present invention.

Based on the above movement, preparation for firing is done and the user may simply pull a trigger to make the high pressure air input again through the high pressure air opening 22 to accompany a firing operation. Specifically, when the high pressure air enters again, since there is one BB bullet already existing in the bullet chamber 62 and the BB bullet blocks the connection between the air outlet opening 23 and the barrel 61, the high pressure air so supplied is only allowed to move toward the piston element 12 and drives the bolt body 1 to move rearward and also, the spring force of the first elastic element 41 that is accumulated due to being compressed by the bolt sleeve 5 would be used such that after the input of the high pressure air is interrupted, the spring force of the first elastic element 41 may return the bolt body 1, and at this moment, the drive channel 11 of the bolt body 1 may cause to impact the drive end 21 of the bullet feeding element 2 to make the bullet feeding element 2, by means of such impact, moving forward and hit the BB bullet inside the bullet chamber 62 to thereby complete a firing operation. After the firing, the operations described above will be repeated to achieve automatic loading of bullets (as shown in FIGS. 11 and 12). Further, when there is a BB bullet inside the bullet chamber 62, to prevent input of an excessive amount of air or gas that causes an excessive extent of rearward movement of the piston element 12 to detach from the drive end 21 of the bullet feeding element 2, a second elastic element 52 can be additionally provided on the bolt sleeve 5 at a location at one side of the first elastic element 41 (wherein the second elastic element 52 has an elastic coefficient that is smaller than that of the first elastic element 41), so that when the bolt sleeve 5 is moving rearward, the second elastic element 52 may provide an effect of pushing or biasing the drive end 21 so as to maintain the spacing between the piston element 12 and the drive end 21 and thus preventing the detachment of the piston element 12 (as shown in FIG. 3).

I claim:

1. A bolt reciprocation structure of a toy gun, the bolt reciprocation structure comprising:

a bolt body, which is arranged inside the toy gun and is reciprocally movable at one side of a barrel of the toy gun;

a bullet feeding element, which is movably disposed between the bolt body and the barrel;

a high pressure air opening, which is defined in the bullet feeding element for input and output of high pressure air through the bullet feeding element;

an air outlet opening, which is defined in a front end of the bullet feeding element;

an air valve assembly, which is arranged on the bullet feeding element to selectively change a flowing direction of the high pressure air through blocking of the air outlet opening;

a piston element, which is defined in the bolt body to drive the bolt body to move when the high pressure air is input;

a recoil bar, which is arranged on the toy gun and is located at one side of the bolt body;

a first elastic element, which is fit to the recoil bar;

at least one bolt sleeve, which is defined at the one side of the bolt body and is movably fit to the recoil bar to be in contact engagement with the first elastic element; and at least one abutting section, which is defined on the at least one bolt sleeve to drive the bullet feeding element to move rearward when the bolt body moves rearward, such that the bullet feeding element is movable with the at least one abutting section of the at least one bolt sleeve in one single direction when the bolt body moves rearward;

wherein the toy gun is provided with a rear stop block that is removably mounted to the toy gun for holding the recoil bar in position.

2. The bolt reciprocation structure of the toy gun according to claim 1, wherein the toy gun comprises a front stop block located at one side of the at least one bolt sleeve to limit a spring-back returning movement of the at least one bolt sleeve.

3. The bolt reciprocation structure of the toy gun according to claim 1, wherein the air valve assembly comprises an air valve spring arranged in the bullet feeding element, a movable member arranged at one side of the air valve spring, an airtight sealing section formed on one side of the movable member that is distant from the air valve spring, and at least one vent hole section formed in the movable member for communication between the high pressure air opening and the air outlet opening.

4. The bolt reciprocation structure of the toy gun according to claim 3, wherein the bullet feeding element comprises a position limiting section for abutting and positioning the airtight sealing section.

5. The bolt reciprocation structure of the toy gun according to claim 1, wherein the at least one bolt sleeve comprises a second elastic element located at one side of the first elastic element for forward pushing of the bullet feeding element.

6. The bolt reciprocation structure of the toy gun according to claim 1, wherein the bullet feeding element comprises at least one drive end, and the bolt body comprises at least one drive channel for receiving and forward driving the at least one drive end.

7. The bolt reciprocation structure of the toy gun according to claim 1, wherein the toy gun comprises a bullet chamber defined at a rear end of the barrel and located at one side of the bullet feeding element and a bullet passage formed in one side of the bullet chamber.

* * * * *